US005183394A

United States Patent [19]

Fujii et al.

[11] Patent Number: 5,183,394

[45] Date of Patent: Feb. 2, 1993

[54] SWASH PLATE TYPE COMPRESSOR WITH A CENTRAL INLET PASSAGE

[75] Inventors: Toshiro Fujii; Hayato Ikeda; Ryo Katoh; Hitoshi Inukai, all of Kariya, Japan

[73] Assignee: Kabushiki Kaisha Toyoda Jidoshokki Seisakusho, Kariya, Japan

[21] Appl. No.: 880,574

[22] Filed: May 8, 1992

Related U.S. Application Data

[63] Continuation-in-part of Ser. No. 863,814, Apr. 6, 1992.

[30] Foreign Application Priority Data

Oct. 5, 1991 [JP] Japan ..... 3-106020

[51] Int. Cl.[5] ..... F04B 27/08

[52] U.S. Cl. ..... 417/269; 91/502; 92/71

[58] Field of Search ..... 184/6.17; 417/269, 271, 417/222 R; 92/71, 110; 91/499, 502; 123/58 BB

[56] References Cited

U.S. PATENT DOCUMENTS

| | | | |
|---|---|---|---|
| 3,079,869 | 3/1963 | Purcell | 91/501 |
| 3,734,647 | 5/1973 | Sparks | 417/269 |
| 3,888,604 | 6/1975 | Oshima et al. | 417/269 |
| 5,052,898 | 10/1991 | Cook | 417/269 |

FOREIGN PATENT DOCUMENTS

| | | |
|---|---|---|
| 54-55711 | 4/1979 | Japan . |
| 60-81484 | 5/1985 | Japan . |

*Primary Examiner*—Leonard E. Smith
*Attorney, Agent, or Firm*—Brooks Haidt Haffner & Delahunty

[57] ABSTRACT

A swash plate type compressor which includes a pair of cylinder blocks. The cylinder blocks contains a crank case and a plurality of cylinders leading to a suction port. A pair of housing sections cover the cylinder blocks, and contain a suction chamber leading to each about the center of the cylinders, and a discharge chamber which is fluidly connected to the cylinders. The cylinder blocks rotatably support a drive shaft. The suction chamber contains a shaft sealing device in order to seal a forward section of the drive shaft. A refrigerant fluid within the crank case is sucked into the cylinders via the suction chamber. A refrigerant passage is provided along the central axis of the drive shaft. A plurality of inlet and outlet ports are connected to the refrigerant passage and to the crank case and suction chamber. The refrigerant passage, the outlet ports and the inlet ports form a refrigerant suction passage. Consequently, the refrigerant concentration in the suction chamber is rendered uniform, and the reliability of the shaft sealing device is improved.

8 Claims, 2 Drawing Sheets

SWASH PLATE TYPE COMPRESSOR WITH A CENTRAL INLET PASSAGE

CROSS REFERENCE TO RELATED APPLICATIONS

This is a continuation in part application of the U.S. application Ser. No. 07/863,814, filed on Apr. 6, 1992, entitled SWASH PLATE TYPE COMPRESSOR WITH A CENTRAL DISCHARGE PASSAGE, which is incorporated herein by reference.

BACKGROUND OF THE INVENTION

This application claims the priority of Japanese Patent Application No. 3-106020 filed May 10, 1991 which is incorporated herein by reference.

1. Field of the Invention

The present invention relates to swash plate type compressors. More particularly, the invention relates to an improved swash plate type compressor for use in vehicles.

2. Description of the Related Art

The Japanese Unexamined Utility Model Publication No. 54-55711 discloses a swash plate type compressor which has a front and rear housing sections, and a front and rear cylinder blocks. A central section connects the front and rear cylinder blocks, and includes a swash plate chamber which is fluidly connected to a refrigerant suction port. Each cylinder block has a distal end which is covered by the front and rear housing sections. A front valve plate is disposed intermediate the front cylinder block and the front housing section. Similarly, a rear valve plate is disposed intermediate the rear cylinder block and the rear housing section.

Each housing section includes a suction chamber and a discharge chamber. The discharge chamber leads to the refrigerant discharge port. A drive shaft is rotatably supported by the cylinder blocks, and is connected to a swash plate located inside a crank case.

Each cylinder block has a plurality of refrigerant suction passages to drive the refrigerant from the crank case to a suction chamber in the housing sections. Each cylinder block also includes a discharge passage which connects a discharge chamber in the front housing to a discharge chamber in the rear housing. The discharge passage is generally disposed concentrically around the outer periphery of the suction passages. A ring shaped lip seal is arranged coaxially with the drive shaft, within the suction chamber, in order to provide an airtight seal around a portion of the drive shaft, so as to prevent refrigerant in the suction chamber from leaking.

When the drive shaft rotates, it frictionally engages the lip seal. Thus, lengthy usage of the compressor subjects the lip seal to significant wear and thermal deformation.

Furthermore, the suction passage is disposed at a relatively remote location from the suction chamber. This causes some irregularity in the distribution of the refrigerant in the suction chamber, and results in a generally non uniform concentration of the refrigerant in the suction chamber.

SUMMARY OF THE INVENTION

It is therefore a main object of the present invention to improve the reliability of the shaft sealing device in a swash plate type compressor, and to achieve a more uniform concentration of the refrigerant in the suction chamber. It is a further object of the present invention to reduce the size and weight of the compressor.

In order to achieve the foregoing objects, the swash plate type compressor is provided with cylinder blocks having a crank case and a plurality of cylinders. A front and rear housing sections are connected to the distal ends of the cylinder blocks in order to cover the cylinders. Each housing section contains a suction chamber leading to a cylinder, and a discharge chamber which is concentrically located outside the periphery of the suction chamber.

The cylinder blocks rotatably support a drive shaft. The suction chamber houses the shaft sealing device. The drive shaft includes a swash plate which is rotatably mounted within the crank case. A plurality of pistons within the cylinder blocks engage the swash plate by means of a pair of shoes.

Refrigerant within the crank case is forced into the cylinders through the suction chamber. The refrigerant is compressed inside the cylinders and is discharged therefrom into the discharge chamber. A discharge passage is provided along the shaft axis, and allows the refrigerant to be discharged. A plurality of outlet and inlet ports connect the crank case and the suction chamber.

BRIEF DESCRIPTION OF THE DRAWINGS

The features of the present invention are set forth with particularity in the appended claims. The invention, together objects and advantages thereof, may best be understood by reference to the following description of the presently preferred embodiments together with the accompanying drawings in which:

DESCRIPTION OF THE PREFERRED EMBODIMENTS

Figure 1:
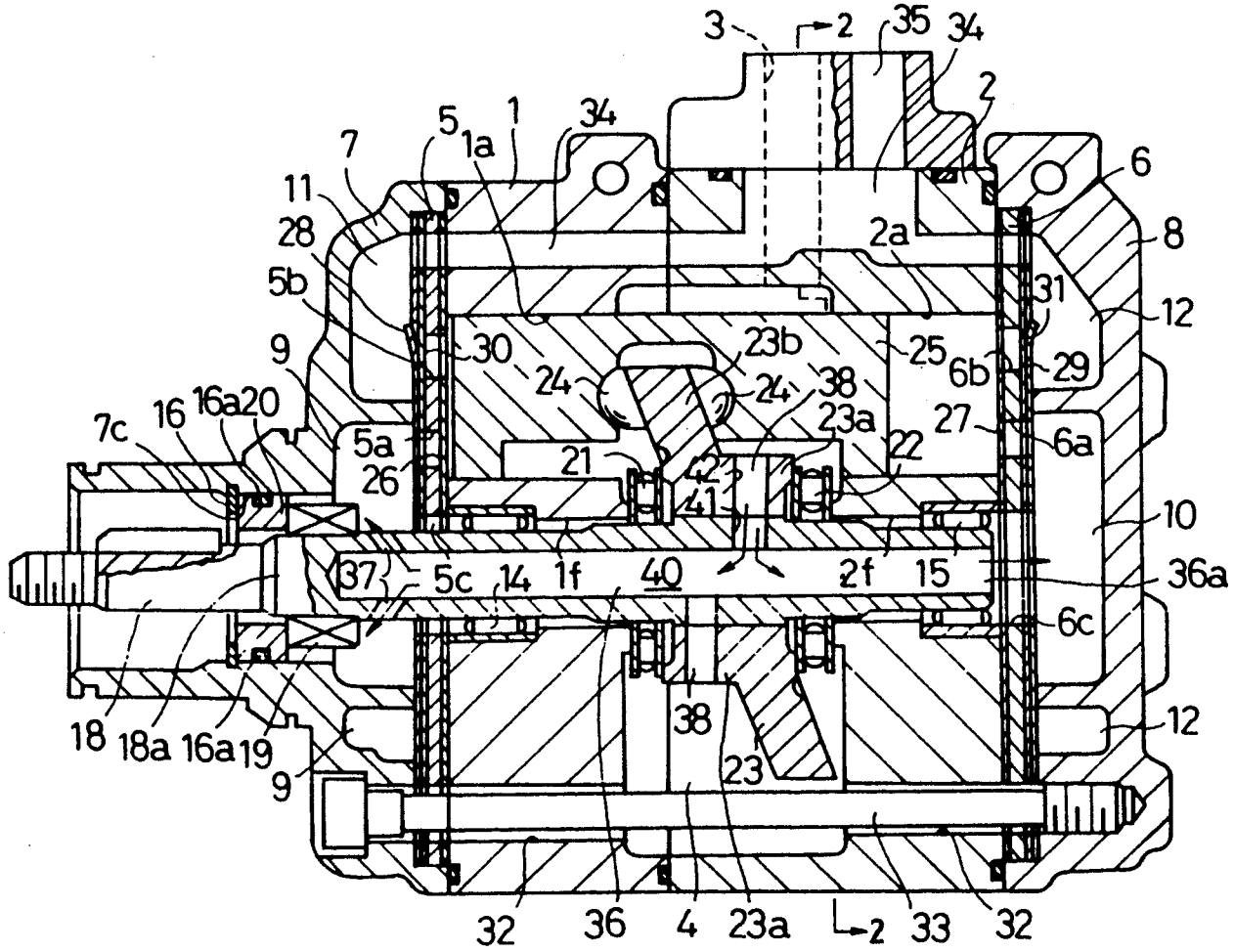
FIG. 1 is a vertical sectional view of a swash plate type compressor according to a first embodiment of the present invention.
Figure 2:
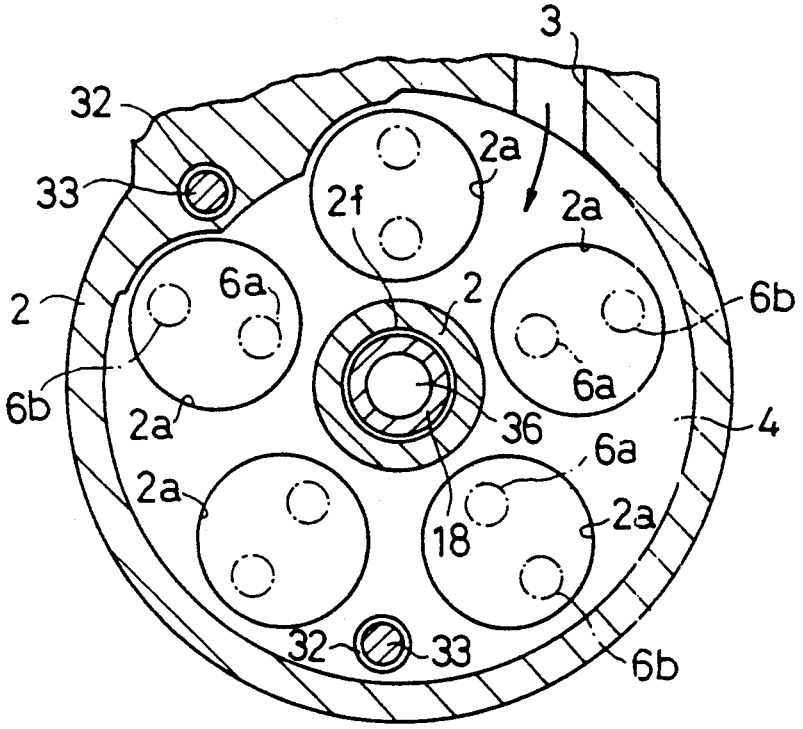
FIG. 2 is a sectional view of the compressor of FIG. 1, taken along line 2—2.

FIG. 1 illustrates the first embodiment of the swash plate type compressor as including a front and a rear cylinder blocks 1 and 2 respectively. The rear cylinder block 2 includes a refrigerant suction port 3. A crank case 4 is centrally disposed with respect to the cylinder blocks 1 and 2, and leads to the suction port 3. The distal end of the front cylinder block 1 and the distal end of the rear cylinder block 2 are covered by a front housing section 7 and a rear housing section 8 respectively. A front valve plate 5 and a rear valve plate 6 are disposed intermediate their respective cylinder blocks and housing sections.

The front housing section 7 and the rear housing section 8 contain suction chambers 9 and 10 respectively. Two ring shaped discharge chambers 11 and 12 are provided within the front housing section 7 and rear housing section 8 respectively. The front discharge chamber 11 and the rear discharge chamber 12 lead to a discharge passage 34 and a discharge port 35 in order to discharge the refrigerant.

Axial cylinders 1*f* and 2*f* are provided within the front and rear blocks. The cylinders *f* and 2*f* rotatably support a drive shaft 18 by means of bearings 14 and 15 respectively. The drive shaft 18 penetrates through an opening 5*c* in the front valve plate 5. An opening 7*c* is provided in the front housing 7 and generally leads to the center of the suction chamber 9. A ring 20 having a stopper 16 and a ring seal 16*a* is retained within the opening 7*c*. A forward section 18*a* of the drive shaft 18 penetrates through the ring 20. A ring shaped rubber lip seal 19 is disposed between the drive shaft 18 and the forward section 18*a*. The lip seal 19 is positioned at about the center of the suction chamber 9. The lip seal 19 provides an airtight seal between the drive shaft 18 and the front housing section 7.

The swash plate 23 is connected to the drive shaft 18, and includes a boss 23*a* and a plate portion 23*b*. The swash plate 23 is supported by the front cylinder block 1 and rear cylinder block 2, by means of bearings 21 and 22 respectively, such that it is rotatable within the crank case 4. The front cylinder block 1 and the rear cylinder block 2 include a plurality of oppositely disposed cylinders 1*a* and 2*a* which are arranged in parallel with the drive shaft 18 at a predetermined distance therefrom.

Each cylinder 1*a* and 2*a* includes a two-headed piston 25 which engages the swash plate 23 via a pair of shoes 24. When the swash plate 23 rotates, the piston 25 causes a slip to the interface between the shoes 24 and the swash plate 23. The front valve plate 5 and the rear valve plate 6 have suction ports 5*a* and 6*a* respectively. The suction ports 5*a* and 5*b* connect the cylinders 1*a* and 2*a* to the suction chambers 9 and 10 via the suction valves 26 and 27 respectively.

The front valve plate 5 and the rear valve plate 6 have discharge ports 5*b* and 6*b* respectively. The discharge ports 5*b* and 6*b* include discharge valves 30 and 31 respectively. The operation of the discharge valves 30 and 31 is controlled by the retainers 28 and 29 respectively. The cylinders 1*a* and 2*a* are connected to the discharge chambers 11 and 12 via the discharge ports 5*b* and 6*b* and the discharge valves 30 and 31.

The rear valve plate 6 has an opening 6*c* which leads to the rear suction chamber 10. The front cylinder block 1 and rear cylinder block 2 include a plurality of outer circumferential holes 32. The front housing section 7, the rear housing section 8, the front cylinder block 1, and the rear cylinder block 2 are interconnected by means of bolts 33 which pass through the holes 32.

One of the important features of the present swash plate type compressor is that the drive shaft 18 has a main passage 36 for the refrigerant to flow therein, along shaft axial direction. The passage 36 has an opening 36*a* at the rear end of the drive shaft 18. The forward section 18*a* of the drive shaft 18 has a plurality of outlet ports 37 which general extend radially from the main passage 36 proximally to the lip seal 19. A pair of inlet ports 38 are provided in the boss 23*a* of the swash plate 23 at predetermined intervals, such that they radially extend to the main passage 36. Each inlet port 38 includes an inner portion 41, and an outer portion 42 within the boss 23*b* of the swash plate 23. The main passage 36, the inlet and outlet ports 38 and 37 form a refrigerant suction passage 40.

The operation of the compressor will now be described in greater detail. When the drive shaft 18 and the swash plate 23 rotate, the piston 25 moves within the cylinders 1*a* and 2*a*, and causes the space volume between the piston 25 and one of the cylinders 1*a* or 2*a* to increase, thus sucking the refrigerant. Subsequently, the space volume is decreased and the refrigerant is compressed. When the refrigerant is sucked into the cylinders 1*a* or 2*a*, the refrigerant which is generally stored separately from the compressor, flows via the suction port 3, the crank case 4, and the inlet port 38, through the main passage 36 of the drive shaft. Thereafter, the refrigerant in the main passage 36 is guided into the front suction chamber 9 via the outlet port 37, and into the rear suction chamber 10 via the opening 36*a*.

When the volume of the cylinders, such as the cylinder 1*a* increases, the refrigerant in the front suction chamber 9 is sucked into the cylinder 1*a* via the suction port 5*a* in the front valve plate 5. Conversely, when the volume of the cylinder 1*a* decreases, the compressed refrigerant is discharged from the cylinder 1*a* into the front discharge chamber 11 via the discharge port 5*b* in the front valve plate 5*a*. The discharged refrigerant flows through the discharge passage 34 and through the external refrigerating circuit via the discharge port 35.

The refrigerant flows via the outlet ports 37 in the drive shaft 18 into the front suction chamber 9, and is uniformly distributed therewithin due to the rotation of the drive shaft 18. The refrigerant is at a relatively cold temperature, and it is sprayed over the lip seal 19 which is located inside the front suction chamber 9. As a result, the lip seal 19 is generally uniformly cooled, and its reliability is improved. Lubricant could also be mixed with refrigerant. The lubricant is generally in a mist state and can easily adhere to the lip seal 19, in order to further improve its reliability. As it is therefore clear from the foregoing description, the position of the outlet ports 37 in close proximity to the lip seal 19 improves the cooling and lubrication, and thus reliability and longevity of the lip seal 19.

The forward section 18*a* of the drive shaft 18 is located at substantially the center of the front suction chamber 9, and the refrigerant flows out through the outlet ports 37 in the rotating drive shaft 18. This results in a generally uniform concentration of the refrigerant in the circumferential direction of the front suction chamber 9, and allows the refrigerant to be substantially uniformly sucked into the cylinders. By arranging the cylinders around the drive shaft 18, the volume effect of the compressor is improved.

When the discharged refrigerant which has been compressed to a high temperature and pressure by the piston 25 passes through the discharge passage 34, it heats up the front and rear cylinder blocks 1 and 2. In the present embodiment, the suction passage 40 includes the main passage 36 which is provided within the drive shaft 18. This arrangement is designed to separate the suction passage 40 from the discharge passage 34, in order to substantially protect the refrigerant in the suction passage 40 from the undesirable heating effect from the discharge passage 34. As a result, the refrigerant is kept at a relatively low temperature, and it is discharged into the refrigerating circuit at a lower temperature than in conventional compressors.

One distinguishing of the present compressor over conventional compressors is that the drive shaft 18 is mainly hollow, to accommodate the suction passage 40 therein. Consequently, the present compressor is lighter and smaller than conventional compressors, and it does not require a separate suction passage.

The inlet ports 38 are described as radially extending in the boss 23*a* of the swash plate 23. However, it should be understood to those skilled in the art that other designs could alternatively be used. The following embodiments illustrate a few of the proposed alternative designs.

Figure 3:
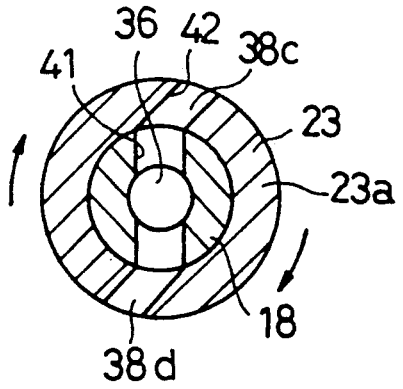
FIG. 3 is a cross sectional view of the boss part of a swash plate used in a compressor according to a second embodiment of the present invention.

FIG. 3 shows the outside portion 42 of inlet ports 38*c* and 38*d* extending forward in the rotational direction (illustrated by the arrows) of the boss 23*a* of the swash plate 23.

Figure 4:
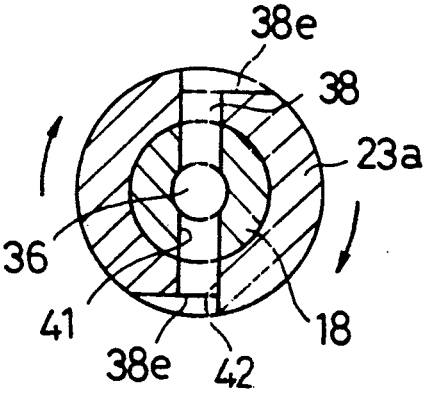
FIG. 4 is a cross sectional view of the boss part of a swash plate used in a compressor according to a third embodiment of the present invention.

FIG. 4 shows a pair of notches 38*e* which act as a guiding means, such that they open in the rotational direction (illustrated by the arrows) of the boss 23*a* of the swash plate 23, and lead to the outside portion 42 of the inlet ports 38. Alternatively, another guiding means can be provided at the outside circumference of the inlet ports 38, such that they have a guiding surface along the rotational direction of the swash plate.

In the foregoing modifications, the refrigerant in the crank case 4 generally flows through the inlet ports 38 via the guiding means during the rotation of the swash plate 23.

What is claimed is:

1. A swash plate type compressor comprising:

a pair of cylinder blocks including a crank case and a plurality of cylinders connected to a suction port;

housing sections for covering said cylinder blocks, said housing sections including a suction chamber leading to each of said cylinders, and a discharge chamber also leading to each of said cylinders;

a drive shaft rotatably supported by said cylinder blocks, said drive shaft having a central axis, and a forward section for engagement to an external driving mechanism;

shaft sealing means disposed substantially within said suction chamber, for sealing said forward section of said drive shaft;

a swash plate mounted on said drive shaft and rotatably housed within said crank case;

a plurality of pistons housed within said cylinders, for engaging said swash plate;

a fluid passage provided along said central axis of said drive shaft, whereby fluid in said crank case is sucked into said cylinders via said suction chamber, and whereby the fluid is compressed in said cylinders and is discharged therefrom into said discharge chamber; and a plurality of outlet and inlet ports leading to said fluid passage, said inlet ports being fluidly opened to said crank case and said outlet ports being opened to said suction chamber, said fluid passage, outlet ports and inlet ports forming a fluid suction passage.

2. The swash plate type compressor according to claim 1, wherein said outlet ports are disposed in close proximity to said shaft sealing means.

3. The swash plate type compressor according to claim 1, wherein said inlet ports include an inside portion which radially extends across the radial wall of said drive shaft and an outside portion which extends radially outwardly from said inside portion into said swash plate.

4. The swash plate type compressor according to claim 3, wherein said outside portion is inclined along the rotational direction of said drive shaft.

5. The swash plate type compressor according to claim 4, further including means for guiding the fluid into said inlet ports.

6. The swash plate type compressor according to claim 5, wherein said guiding means includes at least one notch formed along the rotational direction of said drive shaft.

7. The swash plate type compressor according to claim 1, wherein said discharge chamber is located outside the periphery of said suction chamber.

8. The swash plate type compressor according to claim 7, wherein said discharge chamber is concentrically located with respect to said suction chamber.

* * * * *